US009631358B1

(12) United States Patent
Trahan

(10) Patent No.: US 9,631,358 B1
(45) Date of Patent: Apr. 25, 2017

(54) MODULAR BUILDING SYSTEM

(71) Applicant: Cecil Darel Trahan, Lafayette, LA (US)

(72) Inventor: Cecil Darel Trahan, Lafayette, LA (US)

( * ) Notice: Subject to any disclaimer, the term of this patent is extended or adjusted under 35 U.S.C. 154(b) by 0 days.

(21) Appl. No.: 15/152,695

(22) Filed: May 12, 2016

Related U.S. Application Data

(63) Continuation-in-part of application No. 29/549,885, filed on Dec. 29, 2015.

(51) Int. Cl.

| | |
|---|---|
| ***E04B 1/12*** | (2006.01) |
| ***E04B 1/343*** | (2006.01) |
| ***E04H 1/00*** | (2006.01) |
| ***E04D 13/03*** | (2006.01) |
| ***E04B 1/68*** | (2006.01) |
| ***E04H 1/02*** | (2006.01) |
| ***B63B 35/44*** | (2006.01) |
| ***A63H 33/00*** | (2006.01) |

(52) U.S. Cl.
CPC ..... *E04B 1/34321* (2013.01); *A63H 33/008* (2013.01); *B63B 35/44* (2013.01); *E04B 1/34384* (2013.01); *E04B 1/68* (2013.01); *E04D 13/03* (2013.01); *E04H 1/005* (2013.01); *E04H 1/02* (2013.01); *B63B 2035/4426* (2013.01); *E04B 2001/34389* (2013.01)

(58) Field of Classification Search
CPC ..... E04B 1/34321; E04B 1/6116; E04B 1/34815; E04B 2001/6195; E04B 1/12; E04H 1/1205
USPC ... 52/79.1, 79.5, 79.7, 79.9, 270, 271, 584.1
See application file for complete search history.

(56) References Cited

U.S. PATENT DOCUMENTS

| | | | | |
|---|---|---|---|---|
| 2,691,291 | A * | 10/1954 | Henderson | E04B 1/34823 126/500 |
| 2,806,624 | A * | 9/1957 | Beckner | B65D 19/12 220/485 |
| 6,250,022 | B1 * | 6/2001 | Paz | E04B 1/34321 312/100 |
| 7,289,618 | B2 * | 10/2007 | Lim | H04M 7/0057 379/211.01 |
| 8,695,285 | B2 * | 4/2014 | Reinmann, Jr. | E04H 9/16 299/12 |
| 8,827,763 | B2 * | 9/2014 | DeBlanco | A63H 33/008 119/498 |
| 9,032,670 | B2 * | 5/2015 | Vogler | E04B 1/34321 52/79.9 |
| 9,403,129 | B2 * | 8/2016 | Sasakawa | B01D 63/02 |
| 2002/0152704 | A1 * | 10/2002 | Thompson | E04B 9/245 52/506.06 |

(Continued)

*Primary Examiner* — Rodney Mintz
*Assistant Examiner* — Daniel Kenny
(74) *Attorney, Agent, or Firm* — Dunlap Bennett & Ludwig PLLC

(57) ABSTRACT

A modular building system that is all-inclusive for completing a structural project from the foundation up using unskilled labor is provided. The modular building system includes a plurality of modular sections, each modular section formed from the interconnection of floor, wall, roof, and arch panel components, wherein all panel component interconnections are brought to a locking engagement by way of the same interlocking tabs and rails assembly, so that an unskilled laborer may complete a complete structural project interconnecting various types of modular building sections.

5 Claims, 5 Drawing Sheets

(56) References Cited

U.S. PATENT DOCUMENTS

| | | | | |
|---|---|---|---|---|
| 2005/0235819 | A1* | 10/2005 | Long | B60P 1/6445 89/36.07 |
| 2009/0145051 | A1* | 6/2009 | Andrei | E04H 4/084 52/79.1 |
| 2009/0266005 | A1* | 10/2009 | Snel | E04B 1/34321 52/79.1 |

* cited by examiner

MODULAR BUILDING SYSTEM

BACKGROUND OF THE INVENTION

The present invention relates to modular building systems, and more particularly, to a modular building system that is all-inclusive for completing a structural project from the foundation up using unskilled labor.

Current modular building systems incur expensive labor costs to complete the structural project, which includes the integration of a plurality of building components, such as wall components, foundation components, roofing components, and the like. This is partly due to two reasons: first, current modular building systems involve a plurality of relatively complicated assemblies for interlocking or interconnecting the modular building portions and/or building components together; and second, current modular building systems are not all-inclusive, but rather are completed only when combined with traditional methods and materials of construction. As a result, current modular building systems demand different contractors, wherein each contractor provides a sufficient level of expertise to complete the structural project. For the same reasons, the current modular building systems take longer to complete.

As can be seen, there is a need for a modular building system that is all-inclusive for completing a structural project from the foundation up using unskilled labor.

SUMMARY OF THE INVENTION

In one aspect of the present invention, a modular building system, includes at least one modular building section, each modular building section having two floor panels, two wall panels, two arch panels and one roof panel, wherein each panel extends between two edges, wherein each edge provides at least one rail tab portion protruding therefrom; and a plurality of connector rails, wherein each connector rail is slidable over two adjoining rail tab portions into a locking engagement, wherein each edge provides two opposing rail tab portions, wherein each floor panel provides a plurality of floor voids, and wherein each roof panel provides a plurality of roof voids, and further including a plurality of divider panels sandwiched between adjacent modular building sections, wherein each divider panel provides a peripheral edge; and a plurality of seam rails, wherein each seam rail straddles a portion of the peripheral edges, wherein the plurality of divider panels provide a plurality of divider floor and roof voids that align with the plurality of floor and roof voids, respectively, wherein the plurality of divider panels provide a plurality of divider floor and roof voids that align with the plurality of floor and roof voids, respectively, and wherein each modular building section extends between two opposing section openings; and further providing a plurality of cap panels for enclosing at least one section opening, wherein at least one wall panel provides a door cutout, and wherein at least one arch panel provides a skylight.

In another aspect of the present invention, the modular building system, includes at least one modular building section, each modular building section providing a plurality of floor panels, each floor panel extending between a floor edge and a wall edge; a plurality of wall panels, each wall panel extending between a wall edge and an arch edge; a plurality of arch panels, each arch panel extending between an arch edge and a roof edge; at least one roof panel extending between two roof edges, wherein each edge provides two opposing rail tab portions protruding therefrom in opposite directions; and a plurality of connector rails, wherein each connector rail is slidable over two adjoining rail tab portions into a locking engagement.

These and other features, aspects and advantages of the present invention will become better understood with reference to the following drawings, description and claims.

DETAILED DESCRIPTION OF THE INVENTION

Figure 1:
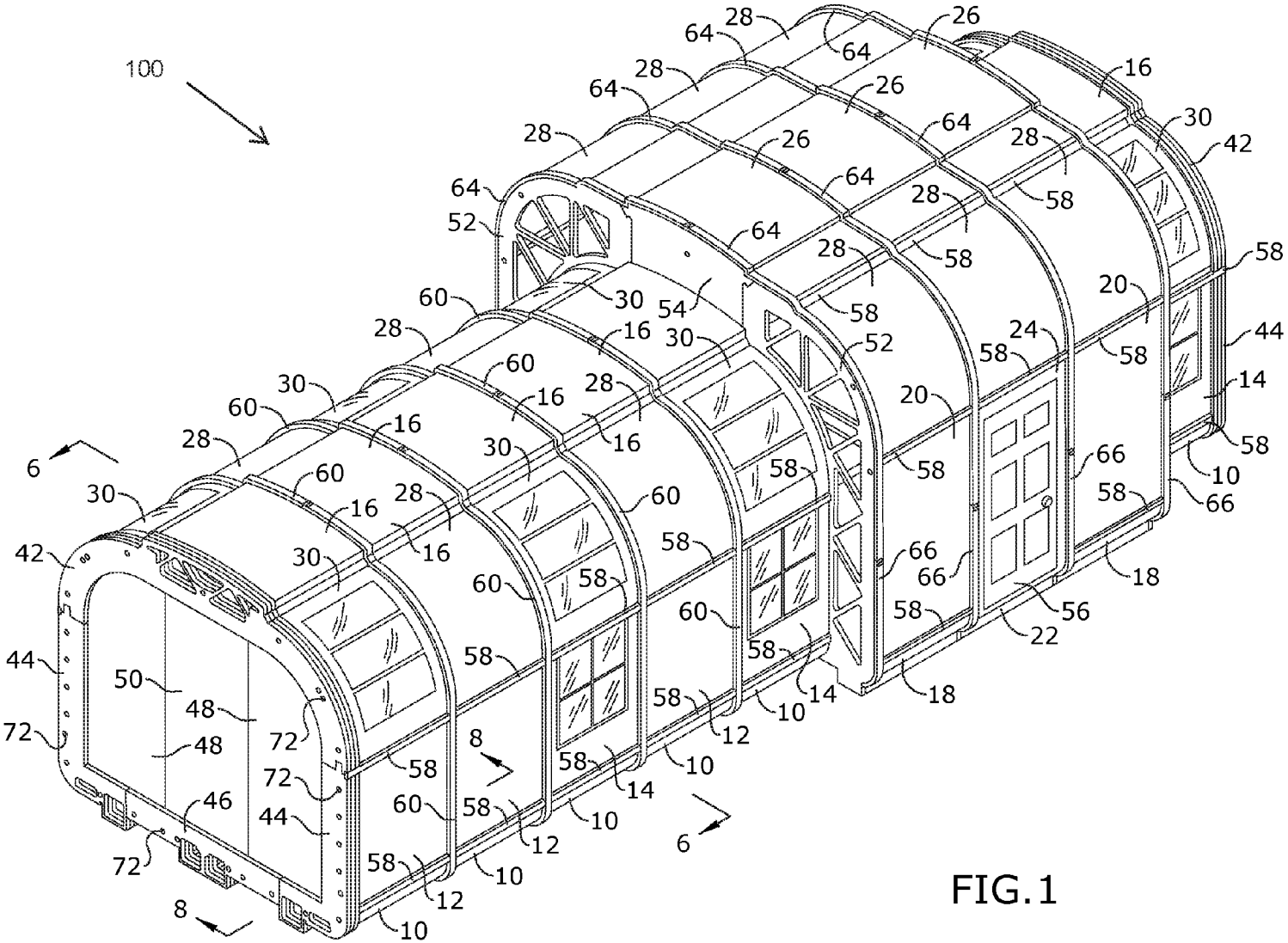
FIG. 1 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a modular building system that is all-inclusive for completing a structural project from the foundation up using unskilled labor. The modular building system includes a plurality of modular sections, each modular section formed from the interconnection of floor, wall, roof, and arch panel components, wherein all panel component interconnections are brought to a locking engagement by way of the same interlocking tabs and rails assembly, so that an unskilled laborer may complete a complete structural project interconnecting various types of modular building sections.

Referring to FIGS. 1 through 9, the present invention may include a modular building system 100. The modular building system 100 includes a plurality of modular sections 80, each modular section 80 formed from the interconnection of floor, wall, roof, and arch components, wherein such components are brought into locking engagement by way of the same interlocking tabs and rails assembly, so that an unskilled laborer may complete a structural project having various modular sections of different sizes, and wherein each section may offer options such as windows, doors, and the like.

The floor components include a first floor panel 10, a second floor panel 18, wherein the difference between the first and second floor panels 10 and 18 is their dimensions, except wherein some first and second floor panels 10 and 18 provide a door cutout 22 adapted to operatively engage a door 56. In certain embodiments, only the second floor panels 18 may provide the door cutout 22.

The wall components include a first wall panel 12, a second wall panel 20, wherein the difference between the first and second wall panels 12 and 20 is their dimensions, except wherein some first and second wall panels 12 and 20 provide a door cutout 24 adapted to operatively engage the door 56 or a window 14. In certain embodiments, only the second wall panels 20 have the door cutout 24 and only the first wall panel 12 may provide the window 14.

The roof components include a first roof panel 16, a second roof panel 26, wherein the difference between the first and second wall panels 16 and 26 is their dimensions.

The arch components interconnect the roof components and the wall components, wherein the arch components include a solid arch panel 28 and a skylight roof arch panel 30.

Figure 6:
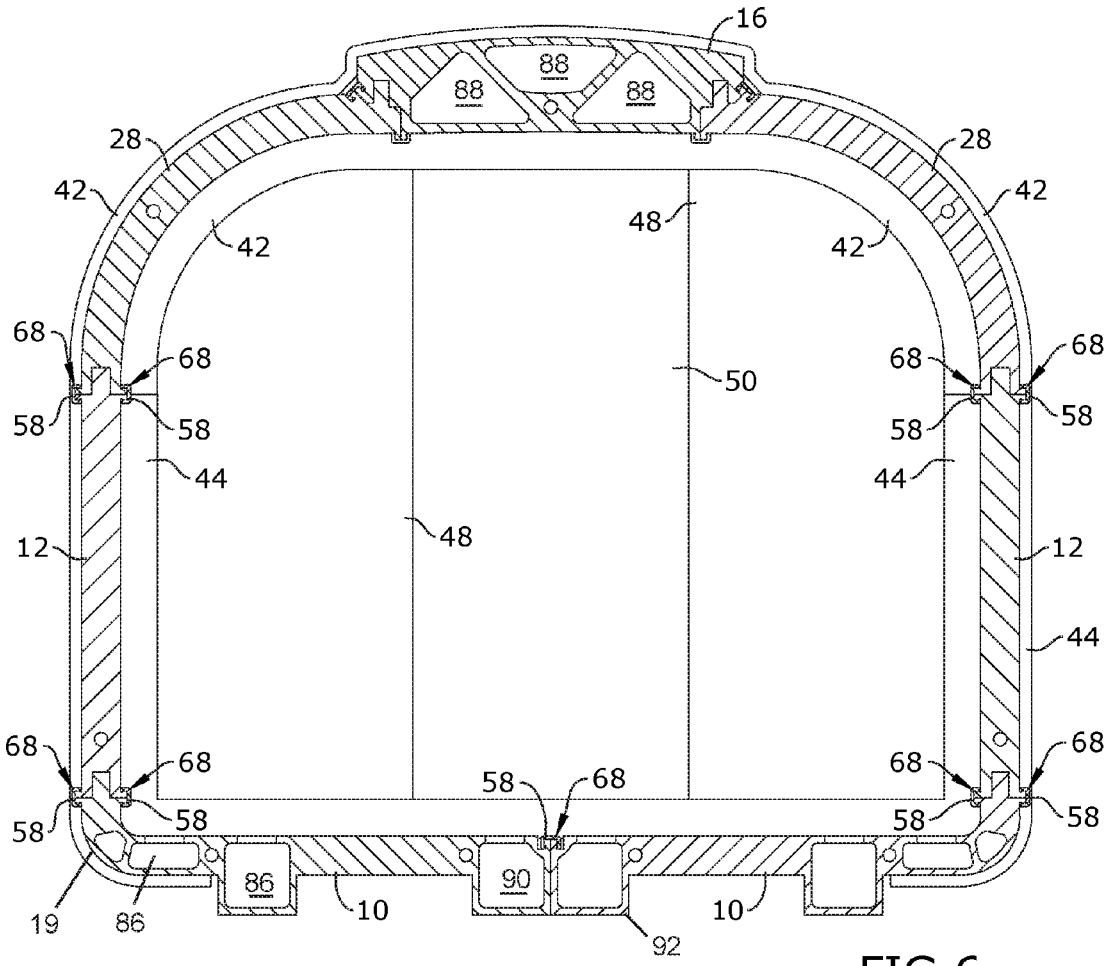
FIG. 6 is a section view of an exemplary embodiment of the present invention, taken along line 6-6 of FIG. 1.
Figure 7:
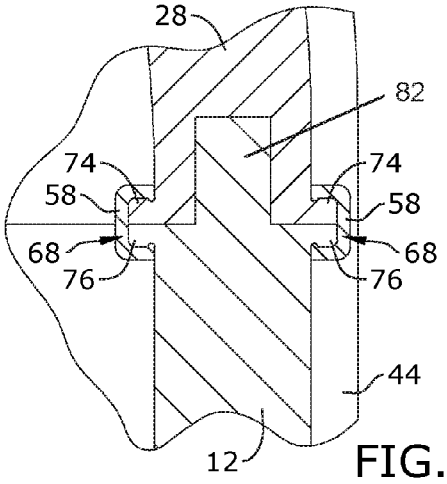
FIG. 7 is a detailed section view of an exemplary embodiment of the present invention.

Each floor panel 10, 18 may extend from a floor edge 11 to a wall edge 13, wherein the wall edge 13 is disposed at the end of a turn 19 so as to be oriented transverse relative to the remaining portion of the associated floor panel. Each floor panel 10, 18 may provide floor voids 86 and 90 there through, as illustrated in FIG. 6. The floor edge 11 may be adapted to adjoin another floor edge on a juxtapositioned floor panel, as illustrated in FIG. 6, thereby forming the floor component of one modular building section 80. The adjoined floor edges 11 may each provide opposing first or second rail tabs 74 or 76 protruding from an associated floor edge 11 so as to define a rail tab 68. The wall edge 13 may provide a male or female mating connector 82 or 84 and opposing first or second rail tabs 74 or 76 protruding from the associated wall edge 13.

Each wall panel 12, 20 may extend from an associated wall edge 13 to an arch edge 15. The arch edge 15 may provide an associated male or female mating connector 82 or 84 and a opposing first or second rail tabs 74 or 76 protruding from the associated arch edge 15. The wall edges 13 of two juxtapositioned wall and floor panels may operatively engage their respective male or female mating connector 82 or 84 so that their respective first and second rail tab 74, 76 define an associated rail tab 68.

Each arch panel 28, 30 may extend from an associated arch edge 15 to a roof edge 17. The roof edge 17 may provide an associated male or female mating connector 82 or 84 and opposing first or second rail tabs 74 or 76 protruding from the associated roof edge 17. The arch edges 15 of two juxtapositioned wall and arch panels may operatively engage their respective male or female mating connector 82 or 84 so that their respective first and second rail tabs 74, 76 define an associated rail tab 68.

Each roof panel 16, 26 may extend between two associated roof edges 17. The roof edges 17 of two juxtapositioned roof and arch panels may operatively engage their respective male or female mating connector 82 or 84 so that their respective first and second rail tabs 74, 76 define an associated rail tab 68. Each roof panel 16 may provide roof voids 88 there through, as illustrated in FIG. 6.

Thereby one modular building section 80 may be provided by two juxtapositioned floor panels, two opposing wall panels, two opposing arch panels and one roof panel interconnecting the two opposing arch panels, wherein each wall panel interconnects the adjacent floor and arch panels, as illustrated in FIG. 6. Again, as mentioned above, the wall and floor panels may provide door cutouts, the wall panels may provide windows, and the arch panel may provide skylights.

Two or more modular building sections 80 may be adjoined so that their relative floor panels align so as to form a continuous flooring component through the two or more modular building sections 80. Two adjoined modular building sections 80 may be interconnected by floor 32, wall 34 or 36, header 38 or 40 divider panels, wherein the header 38 or 40 divider panels are sandwiched by the adjoining roof and arch panels 16, 26 and 28, 30, wherein the wall divider panels 34 or 36 are sandwiched by the adjoining wall panels 12 or 20, respectively, and wherein the floor divider panels are sandwiched by adjoining floor panels 10, 18.

Two modular building sections 80 of different dimensioned by adjoined by interconnecting floor 46, wall 44, header 42 cap panels, wherein the header 42 cap panels are sandwiched by the adjoining roof and arch panels 16, 26 and 28, 30, wherein the wall cap panels 44 are sandwiched by the adjoining wall panels 12 and 20, respectively, and wherein the floor cap panels 46 are sandwiched by adjoining floor panels 10, 18.

Figures 4, 5:
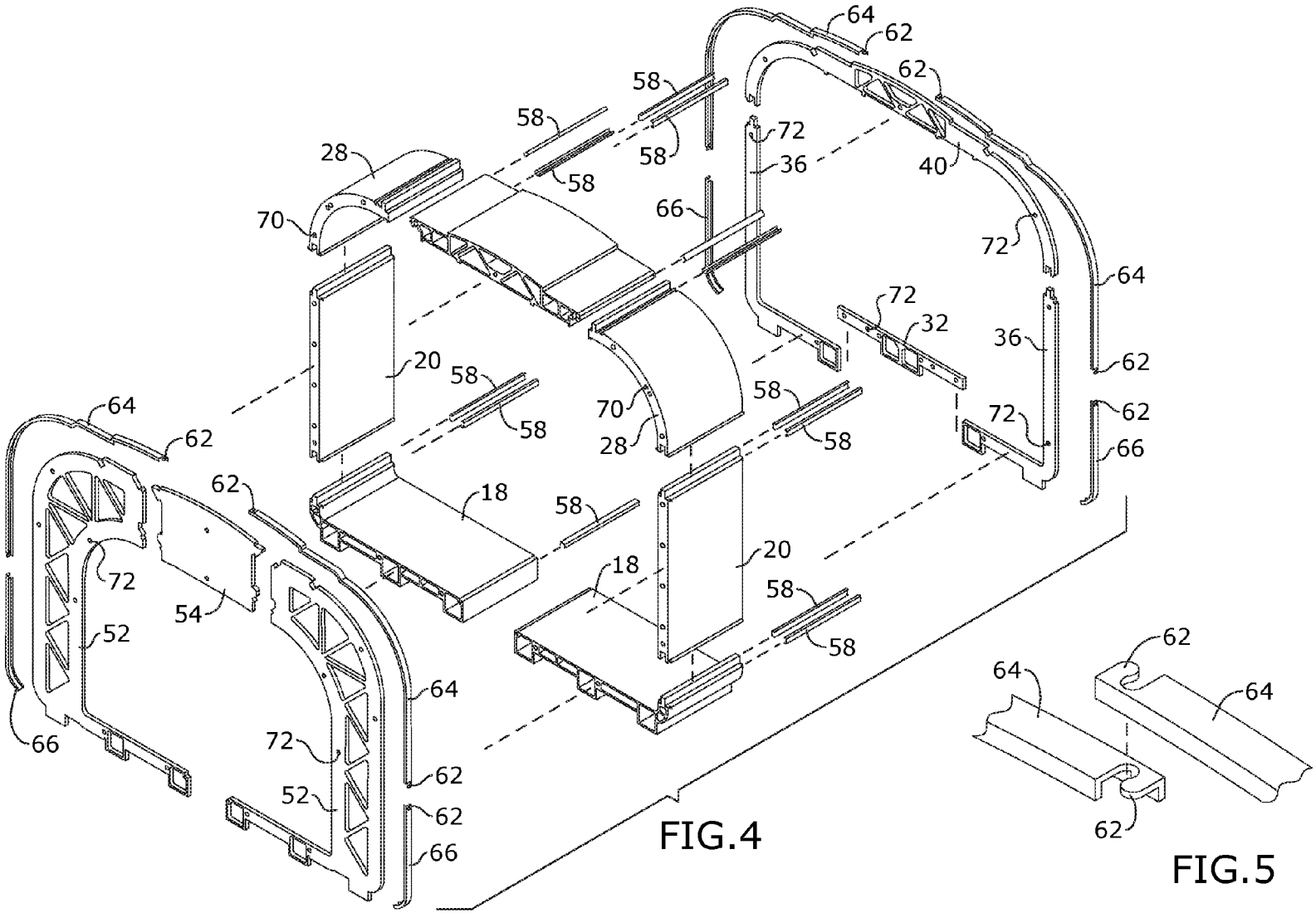
FIG. 4 is an exploded view of an exemplary embodiment of the present invention.
FIG. 5 is a detailed exploded view of an exemplary embodiment of the present invention.

The final of a sequence of modular building sections 80—i.e., the end modular building section 80~may connect to a plurality of stacked floor 46, wall 44, header 42 cap panels forming a peripheral boundary to said end modular building section 80. Alternatively, the cap panels may be adapted in a large header cap panel 54 and a large side cap panels 52, wherein each large side cap panel 52 engages interconnected arch, wall and floor panels 28, 20, 18, as illustrated in FIG. 4. The resulting opening of the peripheral boundary may be closed by end panels 48 and 50. Each modular building section 80 may extend between two opposing section openings, wherein the plurality of cap panels are adapted for enclosing at least one section opening.

Each header and floor cap or divider panel may provide header and floor voids 98 and 96, respectively, that align with the corresponding floor and roof voids 86 and 90 and 88, as illustrated in FIG. 6.

Figures 2, 3:
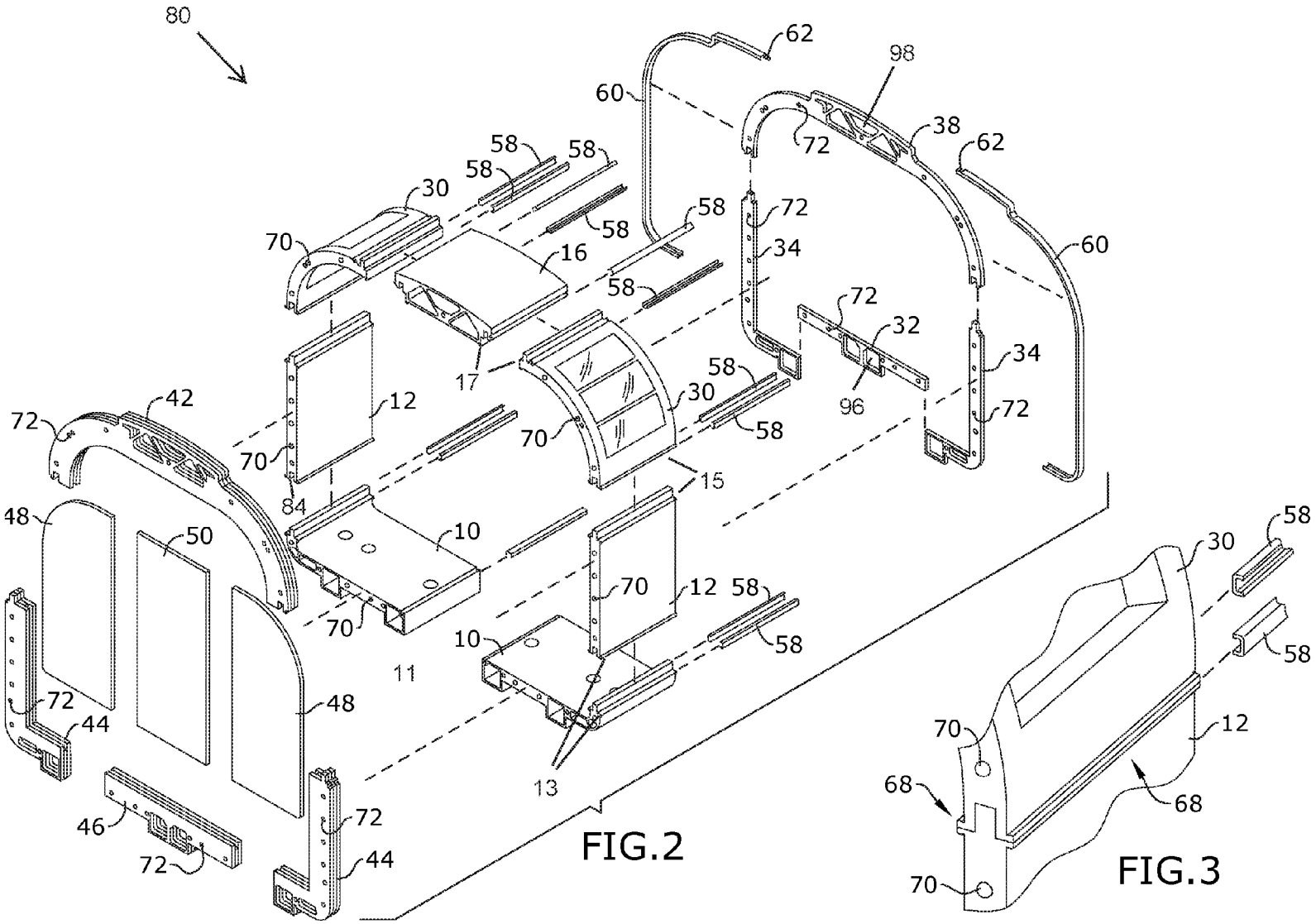
FIG. 2 is an exploded view of an exemplary embodiment of the present invention.
FIG. 3 is a detailed exploded view of an exemplary embodiment of the present invention.
Figure 8:
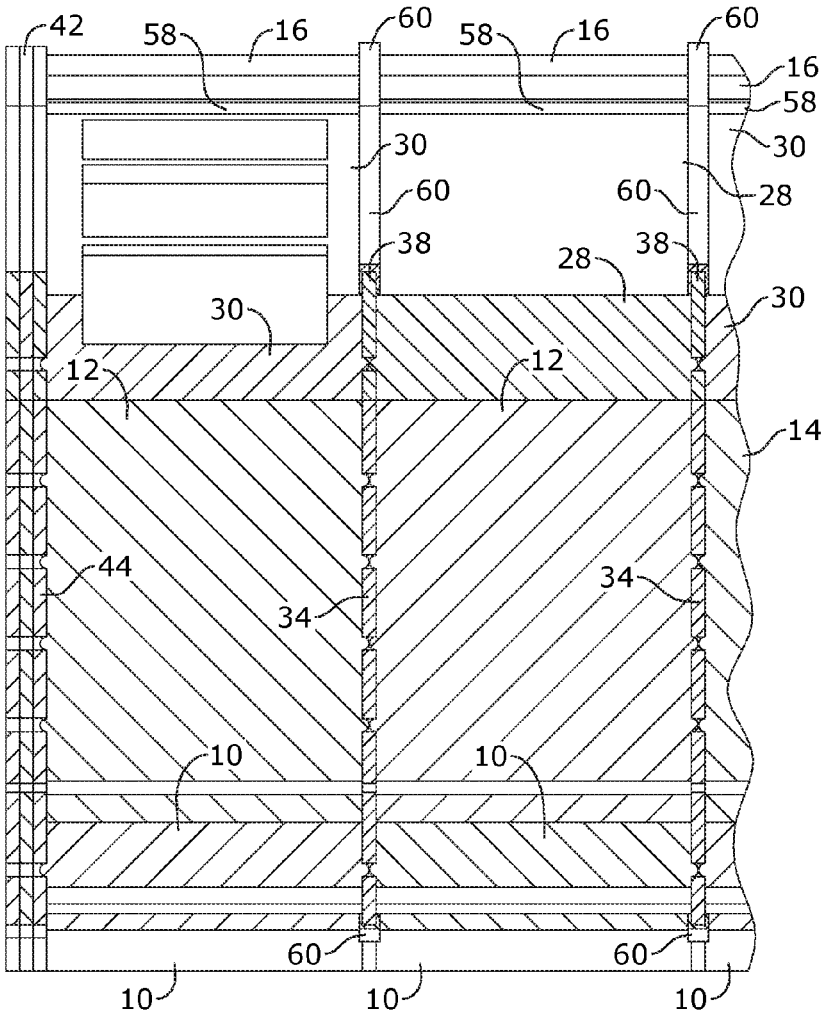
FIG. 8 is a section view of an exemplary embodiment of the present invention, taken along line 8-8 of FIG. 1.
Figure 9:
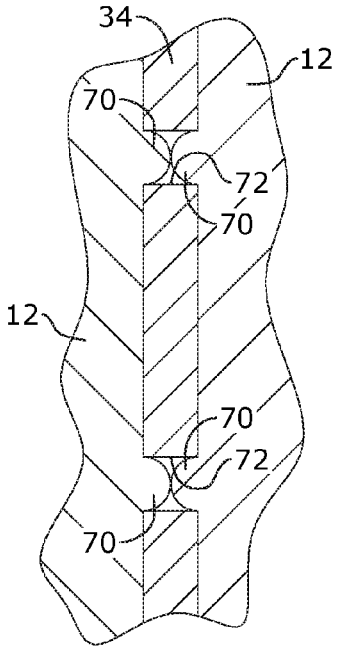
FIG. 9 is a detailed section view of an exemplary embodiment of the present invention.

Each cap or divider panel may provide nub slots 72 along their face sides that align with cooperating nubs 70 along the corresponding face sides of the interconnecting floor, wall, arch and roof panels, as illustrated in FIGS. 2, 4, for securely engagement of cap/divider panels to their corresponding floor, wall, arch and roof panels, as illustrated in FIGS. 8 and 9.

Each divider panel may provide peripheral edges along which a plurality of seam rails 60, 64, 66 may engage so as to form a weatherproof seam between the associated adjoining floor, wall, arch and roof panels that sandwich the corresponding divider panel. Each seam rails 60, 64, 66 may be interconnected by mating jigsaw tabs 62, as illustrated in FIG. 5.

The floor voids 90 may be defined by protrusions 92 that extend from the remaining portion of floor panel 10, 18. An end seam rail 66 may terminate near a protrusion 92 so that the end seam rail 66 encompasses the turn 19, as illustrated in FIG. 6. The turns 19 the arch panels 28, 30 are curved in order to improve the structural strength and lateral resistance relative to wind loads of the completed structure. All panels may be fiberglass molded. Electrical wiring, plumbing piping (not shown) and the like may be placed through the floor voids 86, 90 throughout the entire completed structure. Post tension type cables (not shown) may be passed through the floor and roof voids 86, 90, 88. The post-tension type cables are used to reinforce the strength of the structure, tested up to 160 miles an hour winds.

A plurality of connector rails 58 may be provided so that an unskilled laborer may slide one connector rail 58 along each rail tab 68 securing a locked engagement about said rail tab 68, as illustrated in FIG. 3. The present invention enables unskilled labor to assemble and complete a home or office in a quick and easy way. It can be assembled on site and disassembled to be moved off site. The present invention saves on labor: once the panels/components are connected, the structure is move-in ready in just a few days.

A set of complete and comprehensive plans and detail instructions may be included in each package sent to a user so they can form different type structures: housing, office use, storage use, kids play house, field job sites; temporary housing or office use, a floating platform, or a houseboat. A great do it yourself product, or otherwise making attractive housing and construction more affordable.

It should be understood, of course, that the foregoing relates to exemplary embodiments of the invention and that modifications may be made without departing from the spirit and scope of the invention as set forth in the following claims.

What is claimed is:

1. A modular building system, comprising:

at least one modular building section, each modular building section comprising:

two floor panels, two wall panels, two arch panels and one roof panel, wherein each panel extends between two edges, wherein each edge provides at least one rail tab portion protruding therefrom, wherein each edge provides two opposing rail tab portions, wherein each floor panel provides a plurality of floor voids, and wherein the roof panel provides a plurality of roof voids;

a plurality of connector rails, wherein each connector rail is slidable over two adjoining rail tab portions into a locking engagement;

a plurality of divider panels sandwiched between adjacent modular building sections, wherein each divider panel provides a peripheral edge; and a plurality of seam rails, wherein each seam rail straddles a portion of the peripheral edges.

2. The modular building system of claim 1, wherein the plurality of divider panels provide a plurality of divider floor and roof voids that align with the plurality of floor and roof voids, respectively.

3. The modular building system of claim 2, wherein each modular building section extends between two opposing section openings; and further comprising a plurality of cap panels for enclosing at least one section opening.

4. The modular building system of claim 1, wherein at least one wall panel provides a door cutout.

5. The modular building system of claim 1, wherein at least one arch panel provides a skylight.

* * * * *